US009771240B2

(12) United States Patent
Martin

(10) Patent No.: US 9,771,240 B2
(45) Date of Patent: Sep. 26, 2017

(54) INERTIAL MEASUREMENT UNIT ASSISTED ELEVATOR POSITION CALIBRATION

(71) Applicant: OTIS ELEVATOR COMPANY, Farmington, CT (US)

(72) Inventor: Michael A. Martin, East Hartford, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 337 days.

(21) Appl. No.: 14/440,213

(22) PCT Filed: Nov. 5, 2012

(86) PCT No.: PCT/US2012/063494

§ 371 (c)(1),
(2) Date: May 1, 2015

(87) PCT Pub. No.: WO2014/070203

PCT Pub. Date: May 8, 2014

(65) Prior Publication Data

US 2015/0321879 A1 Nov. 12, 2015

(51) Int. Cl.
*B66B 1/34* (2006.01)
*B66B 1/36* (2006.01)

(52) U.S. Cl.
CPC ..... *B66B 1/3492* (2013.01); *B66B 1/34* (2013.01); *B66B 1/36* (2013.01)

(58) Field of Classification Search
CPC ..... B66B 1/36; B66B 1/34; B66B 1/3492
USPC ..... 187/248, 393, 394
See application file for complete search history.

(56) References Cited

U.S. PATENT DOCUMENTS

| | | | | |
|---|---|---|---|---|
| 1,750,592 A | | 3/1930 | Hance | |
| 4,750,592 A | | 6/1988 | Watt | |
| 4,798,267 A | * | 1/1989 | Foster | B66B 1/3492 187/389 |
| 5,294,757 A | * | 3/1994 | Skalski | B66B 1/44 187/393 |
| 5,321,217 A | * | 6/1994 | Traktovenko | B66B 1/44 187/393 |

(Continued)

FOREIGN PATENT DOCUMENTS

| | | |
|---|---|---|
| CN | 1134392 A | 10/1996 |
| WO | 0170613 A1 | 9/2001 |

OTHER PUBLICATIONS

Chinese Office Action and Search Report for application CN 201280076871.0, dated Apr. 25, 2016, 9 pages.

(Continued)

*Primary Examiner* — David Warren
(74) *Attorney, Agent, or Firm* — Cantor Colburn LLP

(57) ABSTRACT

Embodiments are directed to reducing at least one dynamically generated error in terms of an actual position of an elevator car, comprising: triggering an inertial measurement unit (IMU) to compute a position of an elevator car of an elevator system, obtaining a position of a correcting vane in a hoist-way of the elevator system, obtaining a position of the elevator car as determined by an encoder of the elevator system, and estimating the position of the elevator car based on the computation of the position by the IMU, the position of the correcting vane, and the position of the elevator car as determined by the encoder.

22 Claims, 3 Drawing Sheets

(56) References Cited

U.S. PATENT DOCUMENTS

| | | | | |
|---|---|---|---|---|
| 5,322,144 | A * | 6/1994 | Skalski | B66B 1/44 187/393 |
| 5,373,123 | A * | 12/1994 | Skalski | G01B 7/345 187/391 |
| 5,896,949 | A | 4/1999 | Hamdy et al. | |
| 9,457,988 | B1 * | 10/2016 | Anderson | B66B 5/16 |
| 2011/0048861 | A1 | 3/2011 | Ma et al. | |
| 2012/0193169 | A1 * | 8/2012 | Mizon | B66B 1/00 187/247 |
| 2013/0118839 | A1 * | 5/2013 | Penn | B66B 11/06 187/262 |
| 2013/0283907 | A1 * | 10/2013 | Kang | B66B 1/3492 73/504.02 |
| 2015/0314985 | A1 * | 11/2015 | Schoenauer | B66B 1/3492 187/394 |
| 2015/0321879 | A1 * | 11/2015 | Martin | B66B 1/3492 187/394 |
| 2016/0221794 | A1 * | 8/2016 | Stolt | B66B 5/14 |
| 2016/0304313 | A1 * | 10/2016 | Kinnari | B66B 5/0018 |
| 2017/0008730 | A1 * | 1/2017 | Kattainen | H02P 23/0004 |
| 2017/0015526 | A1 * | 1/2017 | Fargo | B66B 11/0407 |
| 2017/0036886 | A1 * | 2/2017 | Penn | B66B 1/3461 |
| 2017/0057780 | A1 * | 3/2017 | Nguyen | B66B 1/3446 |
| 2017/0088396 | A1 * | 3/2017 | Fargo | B66B 1/32 |

OTHER PUBLICATIONS

International Search Report for application PCT/US2012/063494, dated May 13, 2013, 5 pages.
Written Opinion for application PCT/US2012/063494, dated May 13, 2013, 4 pages.

* cited by examiner

INERTIAL MEASUREMENT UNIT ASSISTED ELEVATOR POSITION CALIBRATION

BACKGROUND

In a given elevator system or environment, the actual landing location of an elevator car might not correspond to a commanded landing location. A deviation between the actual landing location of the elevator car and the commanded landing location may have an impact on the operation of the elevator or users (e.g., riders) of the elevator. For example, if an elevator car is ascending an elevator shaft or hoist-way and stops short of an intended landing location (e.g., a landing floor), a lip or ridge may exist between the elevator car and the floor. Such a lip may cause a rider to clip her shoe when exiting the elevator car, potentially causing her to stumble. Such a lip may also make it more difficult to remove heavy objects from the elevator. For example, a bellhop pushing a cart of luggage may need to push the cart harder to compensate for the lip.

An improvement in terms of landing accuracy, or a minimization or reduction in terms of a difference between the actual landing location of an elevator car and the commanded landing location of the elevator car, is needed.

BRIEF SUMMARY

An embodiment of the disclosure is directed to a method for reducing at least one dynamically generated error in terms of an actual position of an elevator car, comprising: triggering an inertial measurement unit (IMU) to compute a position of an elevator car of an elevator system, obtaining a position of a correcting vane in a hoist-way of the elevator system, obtaining a position of the elevator car as determined by an encoder of the elevator system, and estimating the position of the elevator car based on the computation of the position by the IMU, the position of the correcting vane, and the position of the elevator car as determined by the encoder.

An embodiment of the disclosure is directed to a system comprising: an elevator car comprising a actuator, a correcting vane coupled to a hoist-way and configured to be triggered by the actuator when the elevator car traverses the hoist-way such that the actuator encounters the correcting vane, an inertial measurement unit (IMU) configured to compute a position of the elevator car responsive to the correcting vane being triggered by the actuator, and a controller comprising a processor configured to estimate a position of the elevator car based on a position of the correcting vane in the hoist-way, the position of the elevator car computed by the IMU, and a position of the elevator car as determined by an encoder.

An embodiment is directed to an apparatus comprising: at least one processor; and memory having instructions stored thereon that, when executed by the at least one processor, cause the apparatus to: obtain, from the memory, a position of a correcting vane in a hoist-way of an elevator system, obtain a position of an elevator car of the elevator system as determined by an encoder of the elevator system, and estimate a position of the elevator car between the position of the correcting vane and a position of a commanded landing floor using Kalman filtering applied to: a computation of the position of the elevator car by an inertial measurement unit (IMU), the position of the correcting vane, and the position of the elevator car as determined by the encoder.

Additional embodiments are described below.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
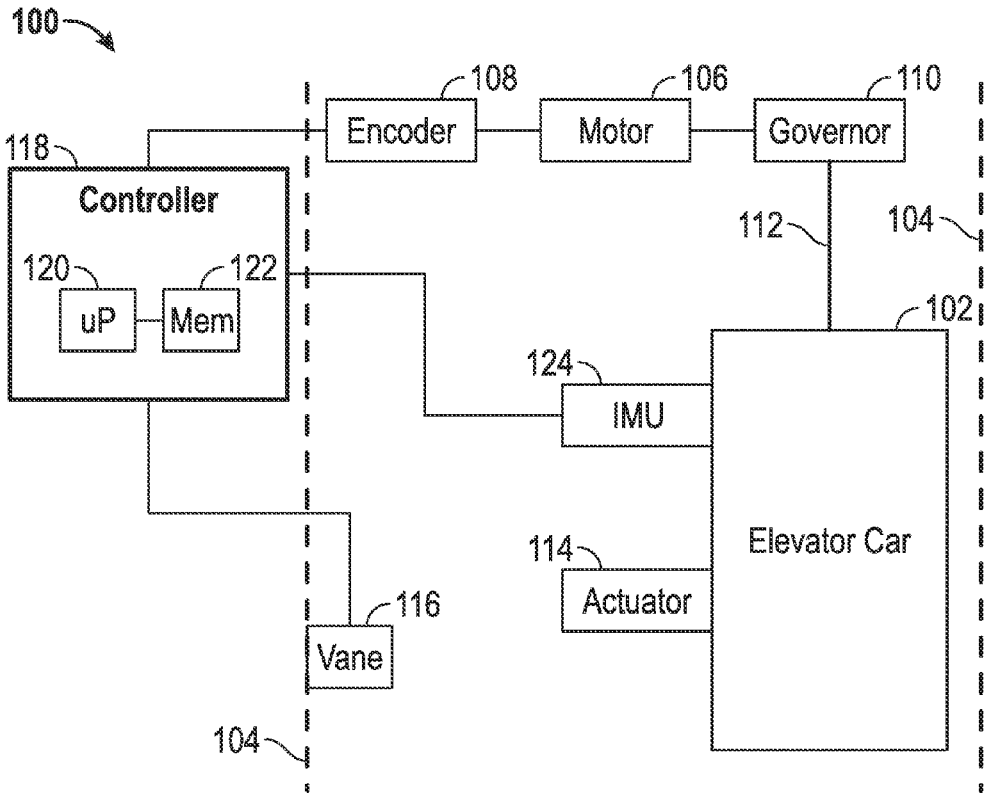
FIG. 1 illustrates an exemplary elevator system in accordance with one or more embodiments of the disclosure.

Exemplary embodiments of apparatuses, systems and methods are described for safely and effectively controlling an elevator. In some embodiments, a difference or deviation between an actual landing location of an elevator car and a desired or commanded landing location of the elevator car may be minimized or reduced. In some embodiments, an actual position of the elevator car may be determined based on one or more inputs. Such inputs may be derived from, or obtained from, one or more inertial measurement units (IMUs), one or more transducers/encoders, and/or one or more correcting vanes.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect. In this respect, a coupling between entities may refer to either a direct or an indirect connection.

FIG. 1 illustrates a block diagram of an exemplary elevator system 100 in accordance with one or more embodiments. The organization and arrangement of the various components and devices shown and described below in connection with the elevator system 100 is illustrative. In some embodiments, the components or devices may be arranged in a manner or sequence that is different from what is shown in FIG. 1. In some embodiments, one or more of the devices or components may be optional. In some embodiments, one or more additional components or devices may be included.

The system 100 may include an elevator car 102 that may be used to convey, e.g., people or items up or down an elevator shaft or hoist-way 104. The elevator car 102 may include an input/output (I/O) interface that may be used by users or riders of the system 100 to select a destination or target landing floor, which may be specified in terms of a floor number. The elevator car 102 may include one or more panels, interfaces, or equipment that may be used to facilitate emergency operations.

The elevator car 102 may be coupled to a motor 106. The motor 106 may provide power to the system 100. In some embodiments, the motor 106 may be used to propel or move the elevator car 102.

The motor 106 may be coupled to an encoder 108. The encoder 108 may be configured to provide a position of a machine or motor 106 as it rotates. The encoder 108 may be configured to provide a speed of the motor 108. For example, delta positioning techniques, potentially as a function of time, may be used to obtain the speed of the motor 108. Measurements or data the encoder 108 obtains from the motor 106 may be used to infer or determine a position of the elevator car 102 as described further below.

The system 100 may include a governor 110. The governor 110 may be configured to control the speed of the elevator car 102 by controlling a speed of one or more pulleys (not shown in FIG. 1). The governor 110 may be coupled to the elevator car 102 by one or more tension members 112.

In some embodiments, the elevator car 102 may include, or be associated with, one or more actuators 114. The one or more actuators 114 may be operative in conjunction with one or more vanes (e.g., correcting vanes) 116. For example, actuator 114 may be a magnet and vane 116 may include a Hall effect sensor. A vane 116 may include a sensor and may be positioned on the hoist-way 104. When an actuator 114 crosses paths with or encounters a vane 116, such as when the elevator car 102 is moving or traversing the hoist-way 104, the vane 116 may be triggered to, in turn, trigger one or more inertial measurement units (IMUs) 124 as described further below.

In some embodiments, a first of the actuators 114 may be located at or near the top of the elevator car 102 and may be used to trigger a vane 116 when the elevator car 102 is ascending in the hoist-way 104. In some embodiments, a second of the actuators 114 may be located at or near the bottom of the elevator car 102 and may be used to trigger a vane 116 when the elevator car 102 is descending in the hoist-way 104.

The elevator car 102 may include, or be associated with, a controller 118. In some embodiments, the controller 118 may include at least one processor 120, and memory 122 having instructions stored thereon that, when executed by the at least one processor 120, cause the controller 118 to perform one or more acts, such as those described herein. In some embodiments, the processor 120 may be at least partially implemented as a microprocessor (uP). In some embodiments, the memory 122 may be configured to store data. Such data may include position data as described further below.

In some embodiments, the controller 118 may be configured to estimate a position of the elevator car 102. The controller 118 may base the estimate of the position on one or more inputs. The inputs may be obtained from, or based on, one or more encoders 108, one or more vanes 116, and one or more IMUs 124.

Figure 2:
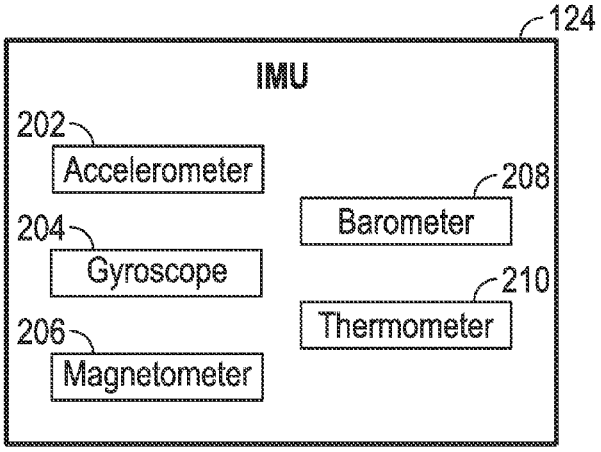
FIG. 2 illustrates an exemplary inertial measurement unit (IMU) in accordance with one or more embodiments of the disclosure.

The IMU 124 may include one or more components or devices. For example, and as shown in FIG. 2, the IMU 124 may include one or more of an accelerometer 202, a gyroscope 204, a magnetometer 206, a pressure sensor or barometer 208, and a temperature sensor or thermometer 210. The structure and function of each of the components 202-210 would be known to one of skill in the art, and as such, a complete description of the components 202-210 is omitted for the sake of brevity. The components 202-210 may be used to characterize the motion or position of the elevator car 102 as described further below.

Referring to FIGS. 1-2, the IMU 124 (in potential combination with the encoder 108, the vane 116, and/or the controller 118) may be used to compensate for errors in the position of the elevator car 102. Such errors may be a result of dynamic effects, such as a stretching of the tension member 112 or rotation or tilt of the elevator car 102 as the elevator car 102 slows down or decelerates to zero speed or velocity, which may be the case when the elevator car 102 approaching a landing floor. The tension member 112 may include one or more of a rope, a belt, and/or a cable. The tension member 112 may be associated with one or more elevator suspension systems or governor-rope tension systems.

In some embodiments, the IMU 124 may, under normal operating conditions, accumulate errors due to one or more factors. For example, such factors may include a numeric integration of bias offsets and environmental factors (e.g., temperature drift on sub-components of the IMU 124). The IMU 124 may need to be recalibrated (or reset) at strategic positions and/or points in time. In some embodiments, a reference system (e.g., an absolute reference system) may be used to recalibrate the IMU 124. The IMU 124 may be recalibrated when the car 102 is stationary (e.g., at zero speed and/or velocity) at a floor or otherwise. In some embodiments, the reference system may be mounted in a pit of the hoist-way 104, potentially away or apart from any significant motion. The reference system may provide known reference values to which outputs of the IMU 124 should be recalibrated when the car 102 is stopped. For example, the reference system may provide axial reference values to which the IMU 124 should be calibrated under stationary (non-moving) conditions.

The IMU 124 may be configured to provide a profile of the elevator car 102's movement along any number of axes. For example, a pitch and roll of the elevator car 102 may be provided in connection with a Cartesian coordinate system (e.g., x-y-z axes), a polar coordinate system, a spherical coordinate system, a cylindrical coordinate system, etc. In some embodiments, a coordinate system to use may be selected. The selection may be specified by a manufacturer of one or more devices, by an operator of an elevator system (e.g., an owner or manager of a building), or by an end user. Parameters (e.g., speed, distance, position, tilt, and rotation) for the elevator car 102 may be provided by the IMU 124 in terms of one or more dimensions (e.g., three-dimensional space).

Figure 3:
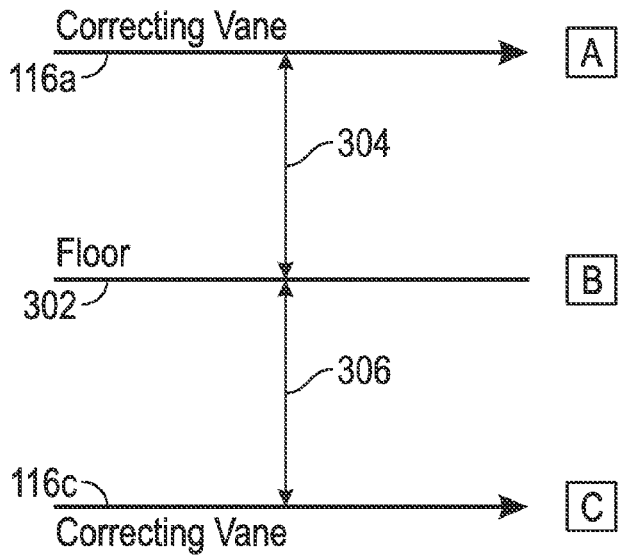
FIG. 3 illustrates exemplary correcting vanes about a landing floor in accordance with one or more embodiments of the disclosure.

Referring to FIGS. 1 and 3, an illustration of vanes **116-*a* and 116-*c* about a floor 302 is shown. The floor 302 may correspond to a position of a reference floor 'B', and may be representative of an intended or commanded landing or stopping point for the elevator car 102 as the elevator car 102 traverses the hoist-way 104. The labels 'A' and 'C' in FIG. 3 may correspond to the positions of the vanes 116-*a* and 116-*c* along the hoist-way 104, respectively. The distance 304 between the correcting vane 116-*a* and the floor 302 and the distance 306 between the correcting vane 116-*c* and the floor 302 may be known based on a prior run of the elevator car 102. In this respect, the positions A and C of the vanes 116-*a* and 116-*c* relative to the floor 302 also may be known. The positions A and C of the vanes 116-*a* and 116-*c* may be stored in one or more memories, such as the memory 122**.

Assuming a vertical orientation as shown in FIG. 3, the vane **116-*a* may be used to track the elevator car 102 as the elevator car 102 descends in the hoist-way 104 towards the floor 302. Similarly, the vane 116-*c* may be used to track the elevator car 102 as the elevator car 102 ascends in the hoist-way 104 towards the floor 302**.

Figure 4:
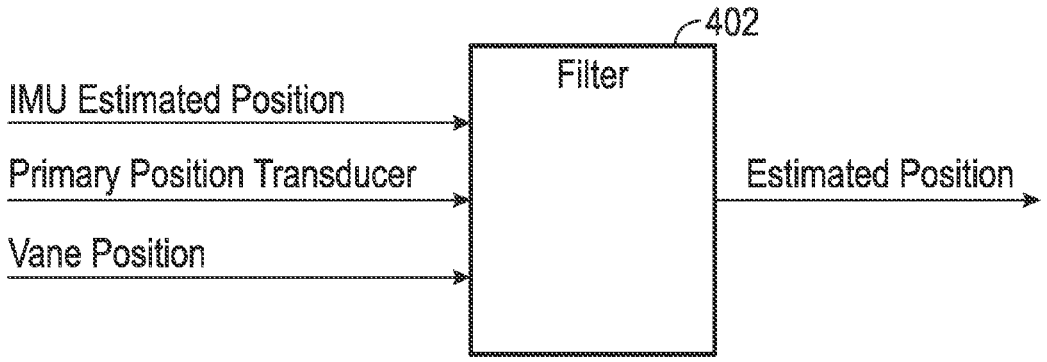
FIG. 4 illustrates an exemplary system for calculating an elevator car position in accordance with one or more embodiments of the disclosure.

Turning now to FIG. 4, a filter 402 is shown. The filter 402 may be implemented by, or in connection with, the controller 118 of FIG. 1. The filter 402 may correspond to a sensory fusion function. In some embodiments, the filter 402 may correspond to, or implement, Kalman filtering (e.g., linear or non-linear Kalman filtering).

The filter 402 may generate an estimated position output, which may correspond to an estimated position of the elevator car 102 at one or more points in time. The estimated position output may be based on one or more inputs. For example, the estimated position output may be based on an estimated position provided by one or more IMUs (e.g., IMU 124), a (primary) position provided by one or more transducers or encoders (e.g., encoder 108), and a position associated with one or more vanes (e.g., vane 116).

Figure 5:
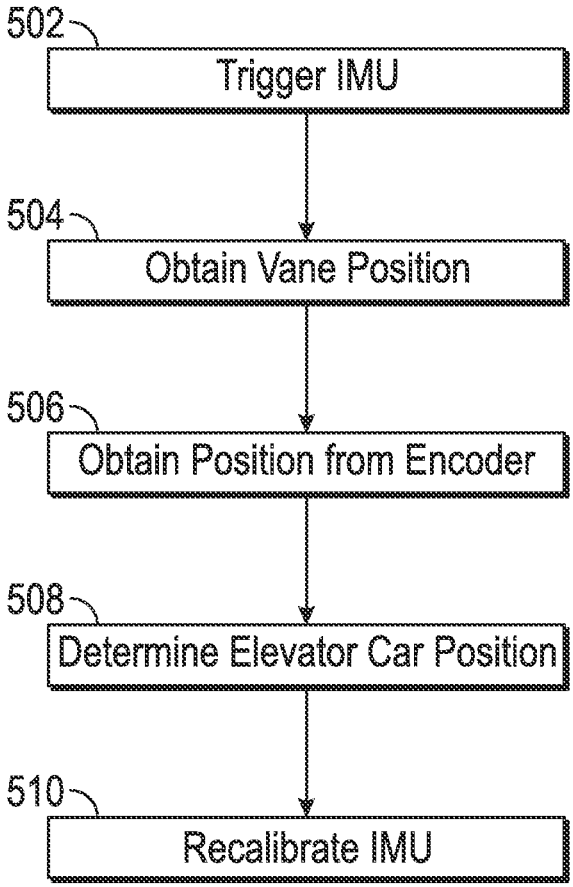
FIG. 5 illustrates a flow chart of an exemplary method in accordance with one or more embodiments of the disclosure.

Turning now to FIG. 5, a flow chart of an exemplary method is shown in accordance with one or more embodiments. The method of FIG. 5 may be used to determine or estimate a position of an elevator car (e.g., the elevator car 102). The method of FIG. 5 may be executed by one or more devices or components, such as the controller 118 of FIG. 1.

In block 502, an IMU (e.g., IMU 124) may be triggered to compute a position of an elevator car (e.g., elevator car 102) relative to a vane (e.g., vane 116-*a* or 116-*c*). The IMU may be triggered in response to the elevator car approaching a stopping floor (e.g., floor 302) and the elevator car (or more specifically, an actuator 114) encountering the vane.

The IMU may compute the position of the elevator car as an incremental position or offset relative to the location of the vane. As described above, the position of the vane may be known from a prior run. In block 504, the position of the vane may be obtained from memory (e.g., memory 122).

In block 506, a position of the elevator car as determined by a transducer or encoder (e.g., encoder 108) may be obtained.

In block 508, a position or location of the elevator car may be determined. The determination of block 508 may be based on the position computed by the IMU (e.g., block 502), the obtained vane position (e.g., block 504), and the position of the elevator car as determined by the encoder (e.g., block 506). In some embodiments, the determination of block 508 may be based on one or more filtering operations, such as described above in connection with FIG. 4.

In block 510, the IMU may be recalibrated. The IMU may be recalibrated to eliminate drift in association with, e.g., one or more components or devices included in the IMU.

The method illustrated in connection with FIG. 5 is illustrative. In some embodiments, one or more of the blocks or operations (or portions thereof) may be optional. In some embodiments, the operations may execute in an order or sequence different from what is shown. In some embodiments, one or more additional operations not shown may be included.

In some embodiments, one or more measurements, computations, or determinations may be based on one or more timestamps. For example, if an IMU exists as a separate node on a network (e.g., a controller area network (CAN) bus) that allows for time synchronization, the IMU may provide both an estimated elevator car position and a corresponding timestamp.

In some embodiments, the IMU may determine the position of the elevator car (e.g., in connection with block 508), and may optionally provide that determination to a controller (e.g., the controller 118). Such a determination may be provided if, for example, the IMU is a separate device or node on a network and the IMU has access to data from the primary position transducer or encoder as well as a learned landing table, which may include information regarding position(s) of the vane(s).

Embodiments of the disclosure may maximize or improve elevator performance. Such maximization or improvement of performance may include compensating for, and minimizing or reducing, dynamically generated errors in the true or actual position of an elevator car that might otherwise be reported by a primary position transducer or encoder.

Embodiments may be tied to one or more particular machines. For example, an IMU or controller may be configured to determine or compute a position of an elevator car. The determination or computation may correspond to an estimate of the position of the elevator car.

In some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors, and memory storing instructions that, when executed by the one or more processors, cause the apparatus or system to perform one or more methodological acts as described herein. In some embodiments, one or more input/output (I/O) interfaces may be coupled to one or more processors and may be used to provide a user with an interface to an elevator system. Various mechanical components known to those of skill in the art may be used in some embodiments.

Embodiments may be implemented as one or more apparatuses, systems, and/or methods. In some embodiments, instructions may be stored on one or more computer-readable media, such as a transitory and/or non-transitory computer-readable medium. The instructions, when executed, may cause an entity (e.g., an apparatus or system) to perform one or more methodological acts as described herein.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. A method for reducing at least one dynamically generated error in terms of an actual position of an elevator car, comprising:

triggering an inertial measurement unit (IMU) to compute a position of an elevator car of an elevator system;

obtaining a position of a correcting vane in a hoist-way of the elevator system;

obtaining a position of the elevator car as determined by an encoder of the elevator system; and estimating the position of the elevator car based on the computation of the position by the IMU, the position of the correcting vane, and the position of the elevator car as determined by the encoder.

2. The method of claim 1, wherein:

the estimating the position of the elevator car is performed by a controller comprising a processor.

3. The method of claim 1, wherein the IMU obtains the position of the correcting vane and the position of the elevator car as determined by the encoder, and wherein the IMU estimates the position of the elevator car.

4. The method of claim 1, wherein the position of the elevator car computed by the IMU is computed in terms of an offset of the elevator car relative to the position of the correcting vane in the hoist-way.

5. The method of claim 1, further comprising:

triggering the IMU to compute the position of the elevator car when the elevator car is decelerating and approaching a landing floor.

6. The method of claim 1, wherein the estimate of the position of the elevator car is based on at least one of linear and non-linear filtering.

7. The method of claim 1, wherein the IMU is triggered to compute the position of the elevator car responsive to an actuator of the elevator car crossing the correcting vane.

8. The method of claim 1, further comprising:

obtaining the position of the correcting vane from a memory, wherein the position of the correcting vane stored in the memory is based on a prior run of the elevator car.

9. The method of claim 1, further comprising:

providing, by the IMU, a timestamp in association with the position of the elevator car computed by the IMU.

10. A system comprising:

an elevator car comprising a actuator;

a correcting vane coupled to a hoist-way and configured to be triggered by the actuator when the elevator car traverses the hoist-way such that the actuator encounters the correcting vane;

an inertial measurement unit (IMU) configured to compute a position of the elevator car responsive to the correcting vane being triggered by the actuator; and a controller comprising a processor configured to estimate a position of the elevator car based on a position of the correcting vane in the hoist-way, the position of the elevator car computed by the IMU, and a position of the elevator car as determined by an encoder.

11. The system of claim 10, wherein the position of the elevator car computed by the is computed in terms of an offset of the elevator car relative to the position of the correcting vane in the hoist-way.

12. The system of claim 10, wherein the IMU is configured to be triggered to compute the position of the elevator car when the elevator car is decelerating and approaching a landing floor.

13. The system of claim 10, wherein the controller is configured to estimate the position of the elevator car based on at least one of linear and non-linear Kalman filtering.

14. The system of claim 10, further comprising:

a memory configured to store the position of the correcting vane in the hoist-way based on a prior run of the elevator car, wherein the controller is configured to obtain the position of the correcting vane from the memory when estimating the position of the elevator car.

15. The system of claim 10, wherein the IMU is configured to provide to the controller a timestamp in association with the position of the elevator car computed by the IMU.

16. The system of claim 10, wherein the correcting vane is proximate to and located below a landing floor and is used by the controller to estimate the position of the elevator car when the elevator car is ascending the hoist-way and approaching the landing floor to stop at the landing floor, the system further comprising:

a second correcting vane proximate to and located above the landing floor, wherein the second correcting vane is used by the controller to estimate the position of the elevator car when the elevator car is descending the hoist-way and approaching the landing floor to stop at the landing floor.

17. The system of claim 10, wherein the controller is configured to estimate the position of the elevator car based on a minimization of at least one dynamically generated error in the actual position of the elevator car.

18. An apparatus comprising:

at least one processor; and memory having instructions stored thereon that, when executed by the at least one processor, cause the apparatus to:

obtain, from the memory, a position of a correcting vane in a hoist-way of an elevator system, obtain a position of an elevator car of the elevator system as determined by an encoder of the elevator system, and estimate a position of the elevator car between the position of the correcting vane and a position of a commanded landing floor using Kalman filtering applied to:

a computation of the position of the elevator car by an inertial measurement unit (IMU), the position of the correcting vane, and the position of the elevator car as determined by the encoder.

19. The apparatus of claim 18, wherein the instructions, when executed by the at least one processor, cause the apparatus to:

receive a selection of a coordinate system, and estimate the position of the elevator car in accordance with a three-dimensional space and in terms of the coordinate system.

20. The apparatus of claim 18, wherein the instructions, when executed by the at least one processor, cause the apparatus to:

estimate the position of the elevator car based on a minimization of at least one dynamically generated error in the actual position of the elevator car, wherein the at least one dynamically generated error comprises at least one of:

stretching of a tension member coupling the elevator car to a governor of the elevator system, rotation of the elevator car, pitch of the elevator car, roll of the elevator car, and tilt of the elevator car.

21. The apparatus of claim 18, wherein the instructions, when executed by the at least one processor, cause the apparatus to:

provide known reference values to which outputs of the IMU are recalibrated.

22. The apparatus of claim 21, wherein the instructions, when executed by the at least one processor, cause the apparatus to:

determine that the elevator car is stopped, and recalibrate the IMU based on determining that the elevator car is stopped.

* * * * *